US005204845A

United States Patent [19]

Stanbury et al.

[11] Patent Number: 5,204,845

[45] Date of Patent: Apr. 20, 1993

[54] CLOCK SYNCHRONIZATION

[75] Inventors: Evan J. Stanbury, Lakemba; Peter G. Jeremy, Enmore, both of Australia

[73] Assignee: Alcatel N.V., Amsterdam, Netherlands

[21] Appl. No.: 691,002

[22] PCT Filed: Nov. 17, 1989

[86] PCT No.: PCT/AU89/00492

§ 371 Date: Jun. 18, 1991

§ 102(e) Date: Jun. 18, 1991

[87] PCT Pub. No.: WO90/07147

PCT Pub. Date: Jun. 28, 1990

[30] Foreign Application Priority Data

Dec. 19, 1988 [AU] Australia ..... PJ2029

[51] Int. Cl.[5] ..... G04F 5/00; G04B 18/00

[52] U.S. Cl. ..... 368/156; 368/201; 331/1 R

[58] Field of Search ..... 368/155-156, 368/200-202; 331/1 R, 34, 177 R

[56] References Cited

U.S. PATENT DOCUMENTS

| | | | |
|---|---|---|---|
| 3,914,706 | 10/1975 | Hammer et al. | 331/1 |
| 4,154,053 | 5/1979 | Chetelat et al. | 58/23 |
| 4,187,518 | 2/1980 | Martin et al. | 358/93 |
| 4,456,386 | 6/1984 | Deliea | 324/497 |
| 4,707,145 | 11/1987 | Ishida | 368/201 |

FOREIGN PATENT DOCUMENTS

| | | |
|---|---|---|
| 1503936 | 5/1978 | France . |
| 62-108184 | 5/1987 | Japan . |
| 62-231201 | 10/1987 | Japan . |
| 1571972 | 7/1980 | Switzerland . |
| B6289B/08 | 5/1976 | U.S.S.R. . |

OTHER PUBLICATIONS

ANSI Standard C12 & 13, "Time-of-Use Registers for Electromechanical Watthour Meters", IEEE Nat'l. Bureau of Standard, 1985, pp. 7-16.

*Primary Examiner*—Vit W. Miska

*Attorney, Agent, or Firm*—Brunell & May

[57] ABSTRACT

A method of adjusting the pulse rate of a local clock (1) by generating a first pulse train at a first predetermined rate, dividing the pulse train by a divisor (3) to produce a second pulse train. The value of the divisor (3) is selected (4,5,6) so that the rate of the second pulse train is adjusted within a predetermined range.

18 Claims, 2 Drawing Sheets

CLOCK SYNCHRONIZATION

TECHNICAL FIELD

This invention relates to a method of and apparatus for adjusting the pulse rate of a local clock to a desired pulse rate. The invention is particularly though not exclusively useful in an arrangement where the clock is incorporated in a remote station associated with a central control station such as, for example, an energy management system, and must be locked into the time of day within a set tolerance and where any clock synchronizing pulse transmitted from the control station to synchronize the local is subjected to random delays in the control station or the transmission medium.

BACKGROUND ART

In a known energy management system used to record consumption of electricity at consumers' premises, electronic registers are used to record the amount of electricity consumed during a number of different tariff rate periods per day. Thus there may be a high tariff rate register, a medium tariff rate register and a low tariff rate register and a time of day clock determines whether consumption occurs during a peak period, a normal period or a low cost period so the meter registrations are recorded in the appropriate register. It is thus necessary for the time of day clocks at each consumer's meter to be accurately locked into the time of day within a set tolerance of e.g. one minute.

In a system where a central computer can monitor the meters at each consumer's premises over the consumer's line, a time signal may be transmitted from the central computer at regular intervals, e.g. once a day. However, the transmission process has an inherent random delay while accessing the subscribers' energy management terminals (EMT). This delay may be of the order of 30 seconds between when the central computer transmits the time signal and when it is received by the EMTs.

There will thus usually be a difference between the time registered by the EMT's time of day clock and the clock synchronizing signal received from the central computer due to drift in the EMT clock and due to the random transmission delay. Both the drift and the delay are unknown parameters but a maximum drift will usually be specied in the tolerances for the EMT. This may be, e.g. 0.04 s per 15 minutes (40 per day).

A further complication may be added if the requirements of the electricity supply authority require that the time intervals for the consumption periods be within a given tolerance. In the US the electricity metering standard ANSI C12.13 requires an accuracy of 15 minutes±0.9 seconds.

This latter requirement means that the EMT clock cannot automatically be reset in synchronism with the received clock synchronization signal because such a time step may exceed the permissible tolerance.

It is an object of the present invention to provide a method of and an apparatus for adjusting the pulse rate of a local clock to obtain a more accurate time signal therefrom in the absence of an accurate clock synchronization signal.

It is a further object of the present invention to provide a method of and an apparatus for adjusting the pulse rate of a local clock to obtain a more accurate time signal therefrom when using a clock synchronization signal for synchronizing said local clock transmitted from a remote station via a communication link which introduces random delays to the transmission of the synchronization signal.

SUMMARY OF THE INVENTION

According to the invention in its broadest form there is provided a method of adjusting the pulse rate of a local clock, said method comprising the steps of generating a first pulse train at a first predetermined rate, dividing said first pulse train by a selectable divisor to produce a second pulse train, the value of said divisor being selected so that the rate of the said second pulse train is varied within a predetermined range.

According to a further aspect of the present invention there is provided a method of synchronizing a local clock means having a plurality of selectable pulse rates, said method comprising the steps of measuring the time difference between the local clock means and an external reference clock and changing the pulse rate of the local clock means such that the said pulse rate is adjusted by an amount not greater than a predetermined rate of adjustment so as to reduce the difference over a period.

According to a still further aspect of the present invention there is provided a method of generating a more accurate time signal from a local clock means having a plurality of selectable pulse rates none of which generate the time signal to a required accuracy, said method comprising the steps of selecting said pulse rates that are slightly higher and slightly lower than a desired pulse rate at a ratio such that the average pulse rate approximates the desired pulse rate.

According to a still further aspect of the present invention there is provided a method of the above mentioned kind, further including the step of measuring the difference between the said average pulse rate and the pulse rate of a clock synchronization signal and changing the said ratio such that the average pulse rate is adjusted by an amount not greater than a predetermined rate of adjustment of the local clock means so as to reduce the said difference over a period of time.

The adjustment is achieved by setting the local clock pulse rate to a pulse rate slightly shorter or longer than its nominal pulse rate. This may be done on a continuous basis or intermittently for a short period at regular intervals until the desired degree of synchronization is achieved. It may be continued until the whole difference is nominally eliminated or until a set portion, e.g. 75% of the tolerance limit is eliminated.

In the case of the energy management system where there is a set tolerance on the accuracy of the metering periods then the rate of adjustment must also be kept within this limit, so the nominal accuracy of the EMT clock sets the lower limit of the rate of adjustment and the allowable tolerance on metering periods sets the upper limit.

According to a still further aspect of the present invention there is provided a method wherein said synchronization signal is transmitted over a telephone line.

BRIEF DESCRIPTION OF DRAWINGS

In order that the invention may be readily carried into effect, embodiments thereof will now be described in relation to the drawings, in which.

BEST MODE OF CARRYING OUT THE INVENTION

Figure 1:
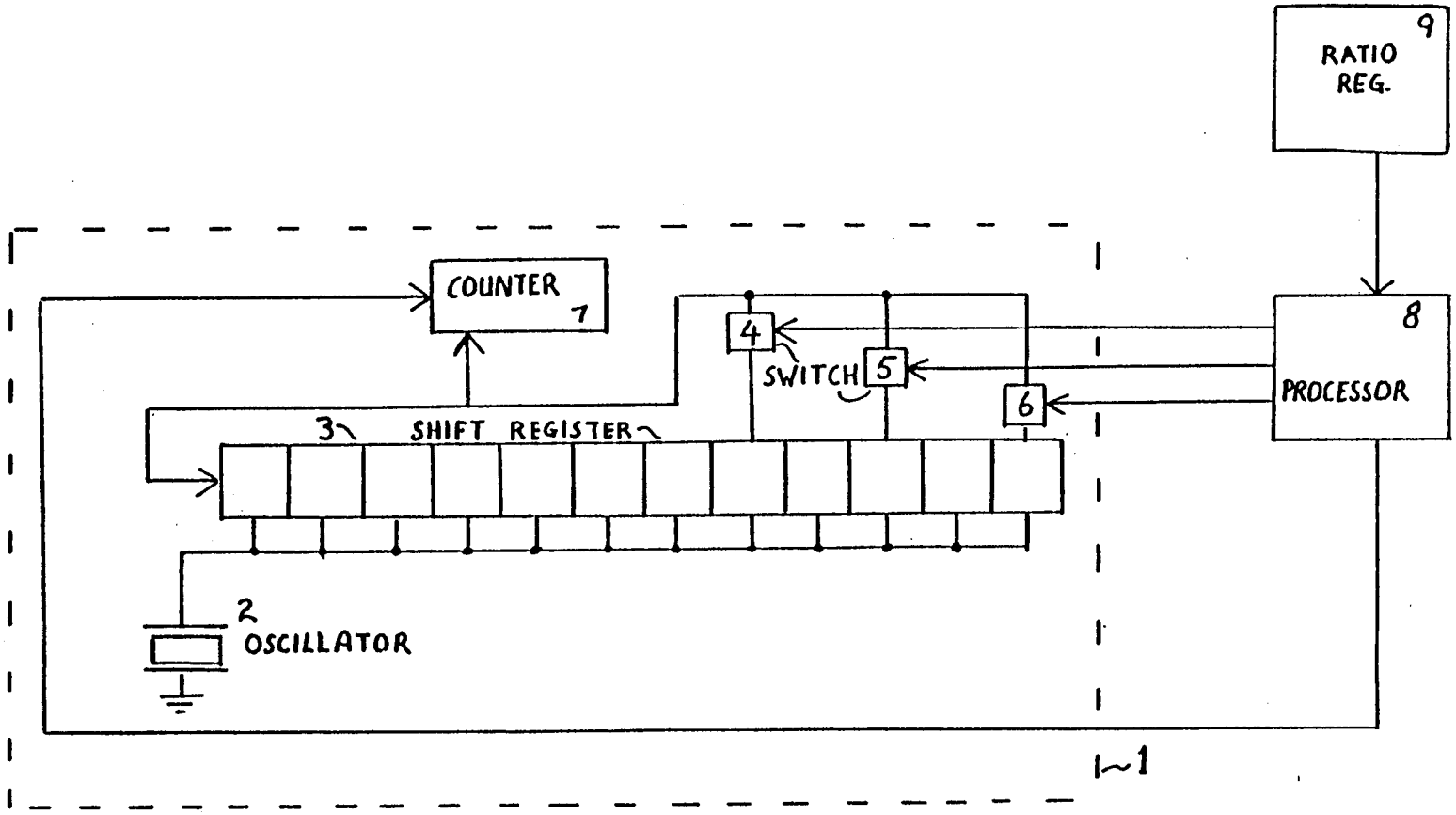
FIG. 1 shows a block diagram of a first embodiment of the present invention for deriving a more accurate time of day from a less than accurate source of synchronization.

Referring to FIG. 1, the arrangement comprises a local clock 1 comprising crystal unit 2, a selectable divisor in the form of a circulating register 3 whose length is varied by gates 4, 5 and 6 tapping some of the register's register elements. Periodic pulses from register 3 drive counter 7 whose content is the time of day. Pulses from register 3 are also coupled into microprocessor 8 which is programmed to select the desired register length via gates 4, 5 and 6. By periodically switching between gates 4, 5 and 6 at a rate determined by a ratio register 9, the microprocessor can alternately select pulse rates which are slightly faster and slightly slower than the required pulse rate. By selecting the period of time at each rate, a more accurate long-term pulse rate can be produced than could be produced by selecting just one of the available gate taps on register 3.

Figure 2:
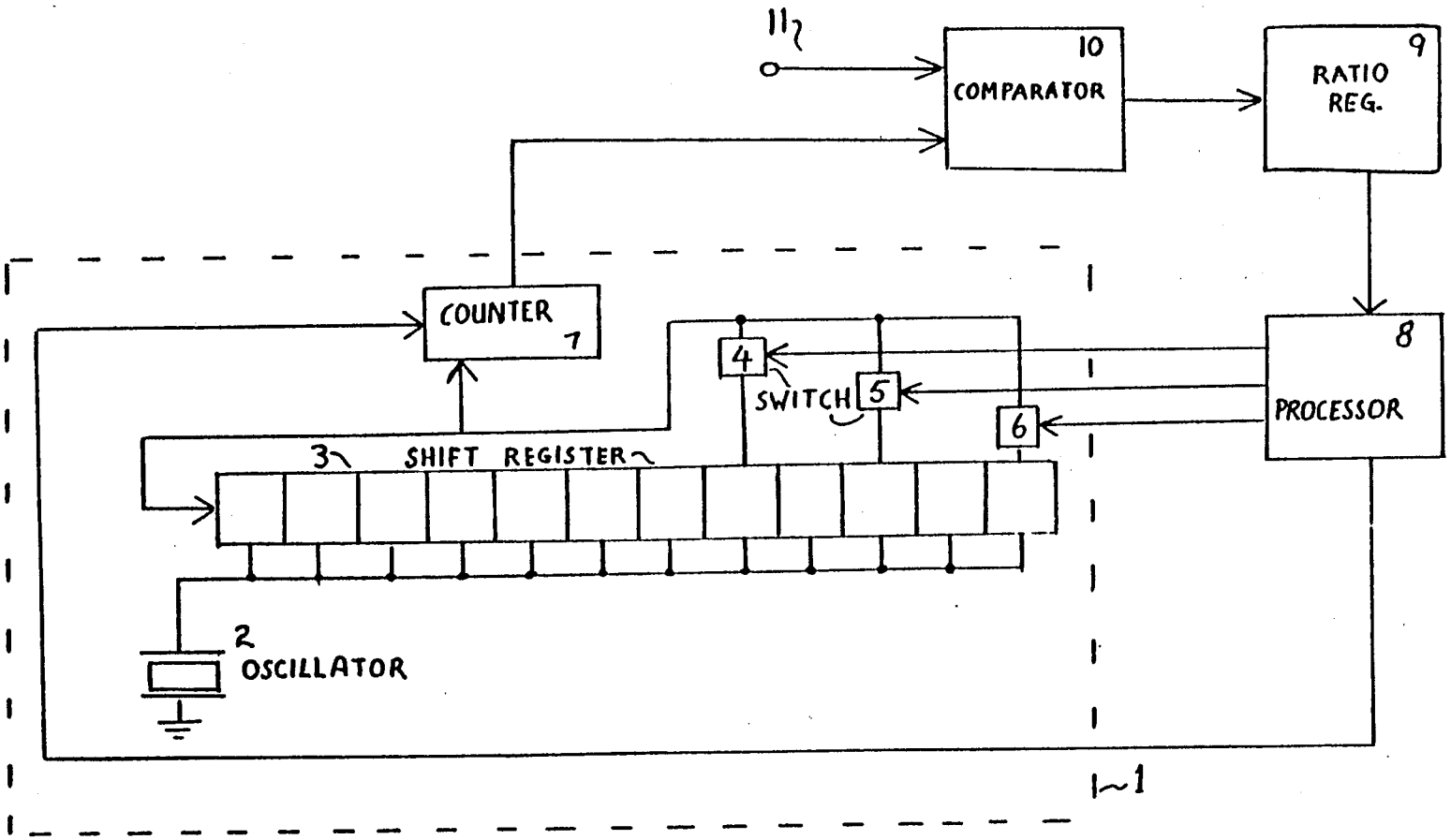
FIG. 2 shows a block diagram of a second embodiment of the present invention for achieving a desired degree of synchronization between a local clock and a clock synchronization signal.

Should the frequency of crystal unit 2 drift over time due to, for example, ageing, the contents of ratio register 9 may be varied by control means to cancel the drift. Such an arrangement will now be described in relation to FIG. 2 which shows an arrangement similar to that described in relation to FIG. 1 except for the inclusion of a comparator means 10 arranged to compare a clock synchronization signal transmitted from a remote control station (not shown) on link 11. The difference between the local clock and the clock synchronization signal derived in comparator means 10 is stored in register 8 and read by microprocessor 8. The length of register 3 is thereby varied by gates 4, 5 and 6. The gate 5 sets the nominal length, then a shorter circulating period can be achieved by switching gates 5 and 6 off and switching on gate 4. Similarly, a longer period can be achieved by switching gates 4 and 5 off and switching gate 6 on. The periodic pulses from register 3 drive counter 7 whose output is the time of day clock.

When a difference between the clock synchronization signal and the time of day clock is registered, microprocessor 8 can switch the register 3 to the longer or shorter mode, that is, gate 4 or gate 6 for a period sufficient to bring the clock within the desired degree of synchronism to reduce the error indicated in register 8. This may be done for a continuous period or at short intervals. When the difference between the clock synchronization signal and the time of day clock exceeds a predetermined value, microprocessor 8 sets the local time of day at counter 7 to that of the incoming clock synchronization signal.

The time difference between the nominal period set by gate 5 and the shorter or longer periods set by gates 4 and 6 can be proportionally greater than the accuracy set by the control station authority if the intermittent correction mode is used.

If the difference is greater than a given amount, for example, due to a power failure or the start of daylight saving, then the microprocessor 8 can set the time of day clock counter 7 in synchronism with the clock synchronization signal in a single step.

While the present invention has been described with regard to many particulars, it is understood that equivalents may be readily substituted without departing from the scope of the invention.

We claim:

1. A method of producing a composite clock signal having a clock rate approximating that of a standard clock signal within a given tolerance limit, the method comprising providing a slow clock signal having a clock rate slightly slower than the standard clock signal by a first difference frequency, providing a fast clock signal having a clock rate slightly faster than the standard clock signal by a second difference frequency, applying the fast clock signal as the composite clock signal for a first portion of a period of time, the actual ratio of said first portion to the whole said period of time being approximately equal to the theoretical ratio of the first difference frequency to the sum of the first and second difference frequencies, applying the slow clock signal as the composite clock signal for the remainder of said period of time, and repeating the foregoing steps for successive periods of time.

2. A method as claimed in claim 1 wherein each said period of time is sufficiently short that the difference between the standard clock signal and the composite clock signal remains within a predetermined said tolerance limit.

3. A method as claimed in claim 1 wherein said remainder and said first portion of the time period are each broken up into shorter mutually interleaved time intervals.

4. A method as claimed in claim 1 wherein the slow clock signal is produced by dividing a supply clock signal by a first divisor and the fast clock signal is produced by dividing the supply clock signal by a second divisor.

5. A method as claimed in claim 1, wherein said fast and slow clock signals are derived from a local oscillator using a divider having a variable divider ratio, said method further comprises the step of reducing the difference between a local clock signal time derived from said composite clock signal and the time indicated by a clock synchronization signal, and said reducing step further comprises the steps of comparing the time indicated by the local clock signal with the time indicated by the synchronization signal to derive a time difference and using said time difference to vary said actual ratio from said theoretical ratio such that the average pulse rate of the divided local oscillator output over a predetermined interval of time is adjusted by an amount not greater than a predetermined rate of adjustment of the local clock signal so as to reduce the said difference over time, said actual ratio being equal to said theoretical ratio when said time difference is substantially eliminated.

6. A method as claimed in claim 5, further comprising the step of comparing by the time indicated clock synchronization signal with the time of the local clock and calculating a time difference signal, the time difference signal being used to adjust said divided local oscillator output within a predetermined range.

7. A method as claimed in claim 5, wherein said actual ratio is equal to said theoretical ratio when said time difference is less than a first predetermined magnitude.

8. A method as claimed in claim 5, wherein if said time difference is greater than a predetermined magnitude, the time difference is eliminated immediately.

9. A method as claimed in claim 5, wherein said clock synchronization signal is transmitted from a remote source at regular intervals.

10. A method as claimed in claim 5, wherein said local clock is incorporated in a terminal at a customer's premises, and said terminal is associated with an energy management terminal.

11. A method as claimed in claim 10, wherein said clock synchronization signal is transmitted from a remote control station associated with the energy management system.

12. A method as claimed in claim 11, wherein said synchronization signal is transmitted over a telephone line.

13. An arrangement for carrying out the method as claimed in claim 6, comprising a pulse generator means for generating a first pulse train at a first predetermined rate, a selectable divisor means operatively associated with said pulse generator such that a second pulse train is produced therefrom, the second pulse train constituting the divided local oscillator output, the value of said divisor being selected so that the rate of said second pulse train is adjusted within a predetermined range, said selectable divisor means further comprising a pulse divider means, and a control means operatively coupled to said pulse divider means for determining the rate of said second pulse train, the second pulse train constituting the divided local oscillator output.

14. An arrangement as claimed in claim 13, wherein said control means is a microprocessor.

15. An arrangement as claimed in claim 14, further comprising comparator means for comparing a clock synchronization signal with the time of the local clock and calculating the time difference signal, said time difference signal being used to adjust said second pulse train within a predetermined range.

16. An arrangement as claimed in claim 13 incorporated in a terminal at a consumer's premises associated with an energy management system.

17. A method as claimed in claim 5, wherein said clock synchronization signal is transmitted from a remote source at irregular intervals.

18. A clock signal generator generating a composite clock signal which approximates a standard clock signal within a given tolerance limit over successive time periods, the generator comprising a source of clock signals, controllable divider means responsive to said clock signals for producing at least a slow clock signal having a clock rate slightly slower than the standard clock signal by a first difference frequency and a fast clock signal having a clock rate slightly faster than the standard clock signal by a second difference frequency, and control means for causing the fast clock signal to be applied to the output of the generator for a first time period portion determined by the ratio of the first difference frequency to the sum of the first and second difference frequencies, and for causing the slow clock signal to be applied to the output of the generator for a remaining time period portion, whereby said composite signal is applied to the output of the generator during said successive time periods.

* * * * *